US008380497B2

(12) United States Patent
Mohammad et al.

(10) Patent No.: US 8,380,497 B2
(45) Date of Patent: Feb. 19, 2013

(54) METHODS AND APPARATUS FOR NOISE ESTIMATION

(75) Inventors: Asif I. Mohammad, San Diego, CA (US); Dinesh Ramakrishnan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 433 days.

(21) Appl. No.: 12/579,322

(22) Filed: Oct. 14, 2009

(65) Prior Publication Data

US 2010/0094625 A1 Apr. 15, 2010

Related U.S. Application Data

(60) Provisional application No. 61/105,727, filed on Oct. 15, 2008.

(51) Int. Cl.
*G10L 21/02* (2006.01)

(52) U.S. Cl. ..... 704/226

(58) Field of Classification Search ..... 704/226
See application file for complete search history.

(56) References Cited

U.S. PATENT DOCUMENTS

| | | | | |
|---|---|---|---|---|
| 7,117,149 | B1 * | 10/2006 | Zakarauskas | 704/233 |
| 7,359,856 | B2 | 4/2008 | Martin et al. | |
| 2006/0111901 | A1 | 5/2006 | Woo | |
| 2007/0027685 | A1 * | 2/2007 | Arakawa et al. | 704/226 |

FOREIGN PATENT DOCUMENTS

| | | | |
|---|---|---|---|
| EP | 1659570 | A1 | 5/2006 |
| JP | 03180900 | | 8/1991 |
| JP | 2003316381 | | 11/2003 |
| JP | 403015897 | * | 1/2012 |
| KR | 20060056186 | A | 5/2006 |
| WO | 0075919 | | 12/2000 |

OTHER PUBLICATIONS

Cohen, "Noise Spectrum Estimation in Adverse Environments: Improved Minima Controlled Recursive Averaging," IEEE transactions on speech and audio processing, vol. 11, No. 5, Sep. 2003.

Haykin, "Adaptive Filter Theory," Englewood Cliffs, NJ: Prentice Hall, 1996, ch. 17.

Hirsch et al. "Noise estimation techniques for robust speech recognition," in Proc. 20th IEEE Int. Conf. Acoustics, Speech, Signal Processing (ICASSP'95), Detroit, MI, May 8-12, 1995, pp. 153-156.

Lee et al. Noise estimation based on standard deviation and sigmoid function using a posteriori signal to noise ratio in nonstationary noisy environments. International Journal of Control, Automation, and Systems, Dec. 2008, vol. 6, No. 6, p. 818-27. Published jointly by the Korean Institute of Electrical Engineers and the Institute of Control, Automation, and Systems Engineers.

Lee et al. Noise Reduction Using the Standard Deviation of the Time-Frequency Bin and Modified Gain Function for Speech Enhancement in Stationary and Nonstationary Noisy Environments. Congress on Image and Signal Processing, 2008. CISP '08 May 27-30, 2008. 2: 54-60.

(Continued)

*Primary Examiner* — Abul Azad

(74) *Attorney, Agent, or Firm* — Michael J. DeHaemer, Jr.; Heejong Yoo

(57) ABSTRACT

A system and method are disclosed for noise level/spectrum estimation and speech activity detection. Some embodiments include a probabilistic model to estimate noise level and subsequently detect the presence of speech. These embodiments outperform standard voice activity detectors (VADs), producing improved detection in a variety of noisy environments.

26 Claims, 6 Drawing Sheets

OTHER PUBLICATIONS

Martin, "Spectral subtraction based on minimum statistics," in Proc. 7th Eur. Signal Processing Conf. (EUSIPCO'94), Edinburgh, U.K., Sep. 13-16, 1994, pp. 1182-1185.

McAulay et al. "Speech enhancement using a softdecision noise suppression filter," IEEE Trans. Acoust., Speech, Signal Processing, vol. ASSP-28, pp. 137-145, Apr. 1980.

McKinley et al. "Model based speech pause detection," in Proc. 22th IEEE Int. Conf. Acoustics, Speech, Signal Processing (ICASSP'97), Munich, Germany, Apr. 20-24, 1997, pp. 1179-1182.

Meyer et al. "Comparison of one- and two-channel noise-estimation techniques," in Proc. 5th Int. Workshop on Acoustic Echo and Noise Control 9IWAENC'97), London, U.K. Sep. 11-12, 1997, pp. 137-145.

Nakayama et al. A noise spectral estimation method based on VAD and recursive averaging using new adaptive parameters for non-stationary noise environments. International Symposium on Intelligent Signal Processing and Communications Systems, 2008. ISPACS 2008. Feb. 8-11, 2009 pp. 1-4.

Ris et al. "Assessing local noise level estimation methods: Application to noise robust ASR," Speech Commun., vol. 34, No. 1-2, pp. 141-158, Apr. 2001.

Sohn et al. "A statistical model-based voice activity detector," IEEE Signal Processing Lett., vol. 6, pp. 1-3, Jan. 1999.

Surendran et al. "Logistic discriminative speech detectors using posterior SNR." IEEE ICASSP, 2004.

Davis, et al., "A multi-decision sub-band voice activity detector" Proceedings EUSIPCO, Sep. 6, 2006, pp. 1-5, XP002559305 Florence, Italy.

International Search Report and Written Opinion—PCT/US2009/060828—ISA/EPO, Dec. 23, 2009.

Jongseo Sohn, et al., "A voice activity detector employing soft decision based noise spectrum adaptation" Acoustics, Speech and Signal Processing, 1998. Proceedings of the 1998 IEEE International Conference on Seattle, WA, USA May 12-15, 1998, New York, NY, USA, IEEE, US, vol. 1, May 12, 1998, pp. 365-368, XP010279166, ISBN: 0-7803-4428-6.

Rainer Martin: "Noise Power Spectral Density Estimation Based on Optimal Smoothing and Minimum Statistics" IEEE Transactions on Speech and Audio Processing, IEEE Service Center, New York, NY, US, vol. 9, No. 5, Jul. 1, 2001, pp. 504-512, XP011054118.

Nakashima H., et al., "Speech Enhancement by Using Statistical Characteristics of Noise," Technical Report of the Institute of Electronics, Information and Communication Engineers, EA, Japan, The Institute of Electronics, Information and Communication Engineers, Nov. 24, 2000, vol. 100, No. 467, EA2000-71, pp. 63-70.

* cited by examiner

METHODS AND APPARATUS FOR NOISE ESTIMATION

CROSS-REFERENCE TO RELATED APPLICATIONS

This application claims priority from U.S. Provisional Patent Application No. 61/105,727, filed on Oct. 15, 2008, which is incorporated herein by reference in its entirety.

BACKGROUND

1. Field of Invention

This disclosure relates generally to methods and apparatus for noise level/spectrum estimation and speech activity detection and more particularly, to the use of a probabilistic model for estimating noise level and detecting the presence of speech.

2. Description of Related Art

Communication technologies continue to evolve in many arenas, often presenting newer challenges. With the advent of mobile phones and wireless headsets one can now have a true full-duplex conversation in very harsh environments, i.e. those having low signal to noise ratios (SNR). Signal enhancement and noise suppression becomes pivotal in these situations. The intelligibility of the desired speech is enhanced by suppressing the unwanted noisy signals prior to sending the signal to the listener at the other end. Detecting the presence of speech within noisy backgrounds is one important component of signal enhancement and noise suppression. To achieve improved speech detection, some systems divide an incoming signal into a plurality of different time/frequency frames and estimate the probability of the presence of speech in each frame.

One of the biggest challenges in detecting the presence of speech is tracking the noise floor, particularly the non-stationary noise level using a single microphone/sensor. Speech activity detection is widely used in modern communication devices, especially for modern mobile devices operating under low signal-to-noise ratios such as cell phones and wireless headset devices. In most of these devices, signal enhancement and noise suppression are performed on the noisy signal prior to sending it to the listener at the other end; this is done to improve the intelligibility of the desired speech. In signal enhancement/noise suppression a speech or voice activity detector (VAD) is used to detect the presence of the desired speech in a noise contaminated signal. This detector may generate a binary decision of presence or absence of speech or may also generate a probability of speech presence.

One challenge in detecting the presence of speech is determining the upper and lower bounds of the level of background noise in a signal, also known as the noise "ceiling" and "floor". This is particularly true with non-stationary noise using a single microphone input. Further, it is even more challenging to keep track of rapid variations in the noise levels due to the physical movements of the device or the person using the device.

SUMMARY

In certain embodiments, a method for estimating the noise level in a current frame of an audio signal is disclosed. The method comprises determining the noise levels of a plurality of audio frames as well as calculating the mean and the standard deviation of the noise levels over the plurality of audio frames. A noise level estimate of a current frame is calculated using the value of the standard deviation subtracted from the mean.

In certain embodiments a noise determination system is disclosed. The system comprises a module configured to determine the noise levels of a plurality of audio frames and one or more modules configured to calculate the mean and the standard deviation of the noise levels over the plurality of audio frames. The system may also include a module configured to calculate a noise level estimate of the current frame as the value of the standard deviation subtracted from said mean.

In some embodiments, a method for estimating the noise level of a signal in a plurality of time-frequency bins is disclosed which may be implemented upon one or more computer systems. For each bin of the signal the method determines the noise levels of a plurality of audio frames, estimates the noise level in the time-frequency bin; determines the preliminary noise level in the time-frequency bin; determines the secondary noise level in the time-frequency bin from the preliminary noise level; and determines a bounded noise level from the secondary noise level in the time-frequency bin.

Some embodiments disclose a system for estimating the noise level in a current frame of an audio signal. The system may comprise means for determining the noise levels of a plurality of audio frames; means for calculating the mean and the standard deviation of the noise levels over the plurality of audio frames; and means for calculating a noise level estimate of the current frame as the value of the standard deviation subtracted from said mean.

In certain embodiments, a computer readable medium comprising instructions executed on a processor to perform a method is disclosed. The method comprises: determining the noise levels of a plurality of audio frames; calculating the mean and the standard deviation of the noise levels over the plurality of audio frames; and calculating a noise level estimate of a current frame as the value of the standard deviation subtracted from said mean.

BRIEF DESCRIPTION OF THE DRAWINGS

Various configurations are illustrated by way of example, and not by way of limitation, in the accompanying drawings.

DETAILED DESCRIPTION

The present embodiments comprise methods and systems for determining the noise level in a signal, and in some instances subsequently detecting speech. These embodiments comprise a number of significant advances over the prior art. One improvement relates to performing an estimation of the background noise in a speech signal based on the mean value of background noise from prior and current audio frames. This differs from other systems, which calculated the present background noise levels for a frame of speech based on minimum noise values from earlier and present audio frames. Traditionally, researchers have looked at the minimum of the previous noise values to estimate the present noise level. However, in one embodiment, the estimated noise signal level is calculated from several past frames, the mean of this ensemble is computed, rather than the minima, and a scaled standard deviation is subtracted of the ensemble. The resulting value advantageously provides a more accurate estimation of the noise level of a current audio frame than is typically provided using the ensemble minimum.

Furthermore, this estimated noise level can be dynamically bounded based on the incoming signal level so as to maintain a more accurate estimation of the noise. The estimated noise level may be additionally "smoothed" or "averaged" with previous values to minimize discontinuities. The estimated noise level may then be used to identify speech in frames which have energy levels above the noise level. This may be determined by computing the a posteriori signal to noise ratio (SNR), which in turn may be used by a non-linear sigmoidal activation function to generate the calibrated probabilities of the presence of speech.

Figure 1:
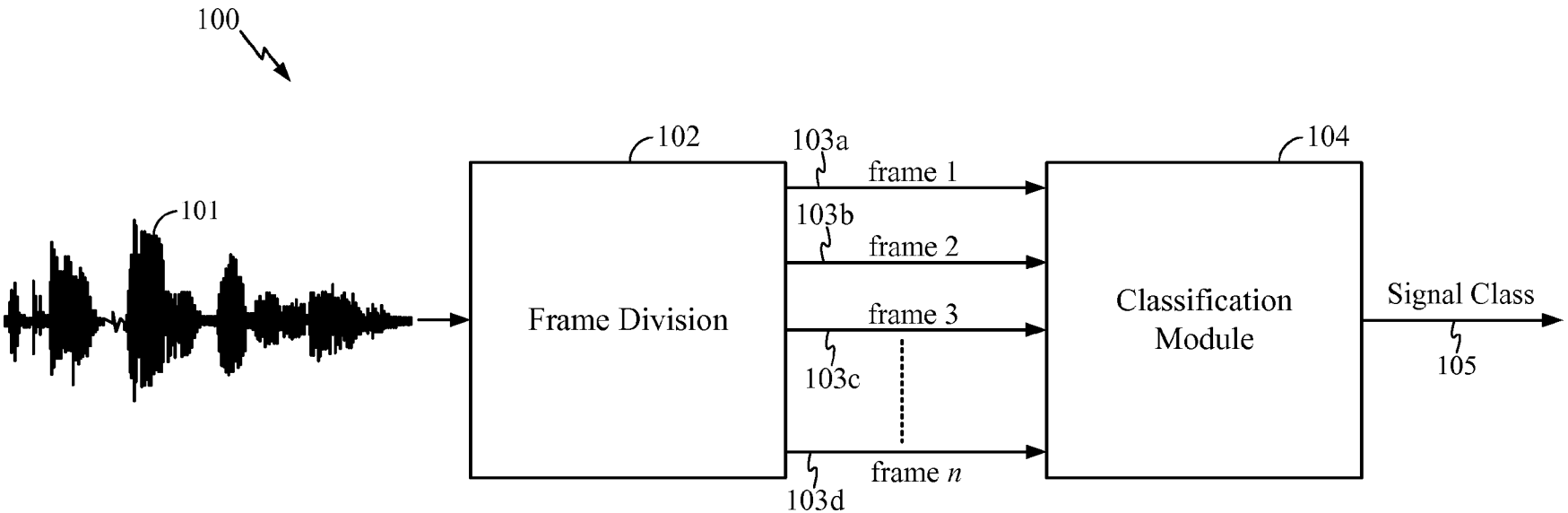
FIG. 1 is a simplified block diagram of a VAD according to the principles of the present invention.

With reference to FIG. 1, a traditional voice activity detection (VAD) system 100 receives an incoming signal 101 comprising segments having background noise, and segments having both background noise and speech. The VAD system 100 breaks the time signal 101 into frames 103*a*-103*d*. Each of these frames 103*a-d* is then passed to a classification module 104 which determines what class to place the given frame in (noise or speech).

The classification module 104 computes the energy of a given signal and compares that energy with a time varying threshold corresponding to an estimate of the noise floor. That noise floor estimate may be updated with each incoming frame. In some embodiments, the frame is classified as speech activity if the estimated energy level of the frame signal is higher than the measured noise floor within the specific frame. Hence, in this module, the noise spectrum estimation is the fundamental component of speech recognition, and if desired, subsequent enhancement. The robustness of such systems, particularly under low SNR's and non-stationary noise environments, is maximally affected by the capability to reliably track rapid variations in the noise statistics.

Conventional noise estimation methods which are based on VADs restrict updates of the noise estimate to periods of speech absence. However, these VADs' reliability severely deteriorates for weak speech components and low input SNRs. Other techniques, based on the power spectral density histograms are computationally expensive, require extensive memory resources, do not perform well under low SNR conditions and are hence not suitable for cell-phones and bluetooth headset applications. Minimum statistics is another method used for noise spectrum estimation, which operates by taking the minimum of a past plurality of frames to be the noise estimate. Unfortunately, this method works well for stationary noise and suffers badly when dealing with non-stationary environments.

One embodiment comprises a noise spectrum estimation system and method which is very effective in tracking many kinds of unwanted audio signals, including highly non-stationary noise environments such as "party noise" or "babble noise". The system generates an accurate noise floor, even in environments that are not conducive to such an estimation. This estimated noise floor is used in computing the a posteriori SNR, which in turn is used in a sigmoid function "the logistic function" to determine the probability of the presence of speech. In some embodiments a speech determination module is used for this function.

Let x[n] and d[n] denote the desired speech and the uncorrelated additive noise signals, respectively. The observed signal or the contaminated signal y[n] is simply their addition given by:

$$y[n]=x[n]+d[n] \tag{1}$$

Two hypothesis, $H_0[n]$ and $H_1[n]$, respectively indicate speech absence and presence in the $n^{th}$ time frame. In some embodiments the past energy level values of the noisy measurement may be recursively averaged during periods of speech absence. In contrast, the estimate may be held constant during speech presence. Specifically, $$H_0[n]:\lambda_d[n]=\alpha_d\lambda_d[n-1]+(1-\alpha_d)\sigma_y^2[n] \quad (2),$$

$$H_1[n]:\lambda_d[n]=\lambda_d[n-1] \tag{3}$$

where $$\sigma_y^2[n]=\sum_{i=n-100}^{n}|y[i]|^2$$

is the energy of the noisy signal at time frame n and $\alpha_d$ denotes a smoothing parameter between 0 and 1. However, as it is not always clear when speech is present, it may not be clear when to apply each of methods $H_0$ or $H_1$. One may instead employ "conditional speech presence probability" which estimates the recursive average by updating the smoothing factor $\alpha_s$ over time:

$$\lambda_d[n]=\alpha_s[n]\lambda_d[n-1]+(1-\alpha_s[n])\sigma_y^2[n] \tag{4}$$

where $$\alpha_s[n]=\alpha_d+(1-\alpha_d)\text{prob}[n] \tag{5}$$

In this manner, a more accurate estimate can be had when the presence of speech isn't known.

Others have previously considered minimum statistics-based methods for noise level estimations. For instance, one can look at the estimated noisy signal level $\lambda_d$ for, say, the past 100 frames, compute the minima of the ensemble and declare it as the estimated noise level i.e.

$$\hat{\sigma}_n^2[n]=\min[\lambda_d(n-100:n)] \tag{6}$$

here min[x] denotes the minima of the entries of vector x and $\hat{\sigma}_n^2[n]$ is the estimated noise level in time frame n. One can perform the operation for more or less than 100 frames, and 100 is offered here and throughout this specification as only an example range. This approach works well for stationary noise but suffers in non-stationary environments.

To address this, among other problems, present embodiments use the techniques described below to improve the overall detection efficiency of the system.

Mean Statistics

In one embodiment, systems and methods of the invention use mean statistics, rather than minimum statistics to calculate a noise floor. Specifically, the signal energy $\sigma_1^2$ is calculated by subtracting a scaled standard deviation a of the past frame values, from the average $\overline{\lambda}_d$. The present energy level $\sigma_2^2$ is then selected as the minimum of all prior calculated signal energies $\sigma_1^2$ from the past frames.

$$\hat{\sigma}_1^2[n]=[\overline{\lambda}_d[n-100:n]-\alpha*\sigma(\lambda_d[n-100:n])] \quad (7),$$

$$\hat{\sigma}_2^2[n]=\min(\hat{\sigma}_1^2[n-100:n]) \tag{8}$$

Where $\overline{x}$ denotes the mean of the entries of vector x. Present embodiments contemplate subtracting a scaled standard deviation of the estimated noise level for over 100 past frames from the mean of the estimated noise level over the same number of frames.

Speech Detection Using the Noise Estimate

Once the noise estimate $\sigma_1^2$ has been calculated, speech may be inferred by identifying regions of high SNR. Particularly, a mathematical model may be developed which accurately estimates the calibrated probabilities of the presence of speech based upon logistic regression based classifiers. In some embodiments a feature based classifier may be used. Since the short term spectra of speech are well modeled by log distributions, one may use the logarithm of the estimated aposteriori SNR rather than the SNR itself as the set of features i.e.

$$\chi[n] = 10\left\{\log_{10}\left(\sum_{i=n-100}^{n} |y[i]|^2\right) - \log_{10}(\sigma^2_{noise}[n])\right\} \tag{9}$$

For stability, one can also do time smoothing of the above quantity:

$$\hat{\chi}[n]=\beta_1\hat{\chi}[n-1]+(1-\beta_1)\chi[n]$$

$$\beta_1\epsilon[0.75,0.85] \tag{10}$$

A non-linear and memory less activation function known as a logistic function may then be used for desired speech detection. The probability of the presence of speech at the time frame n is given by:

$$prob[n] = \frac{1}{1+\exp(-\hat{\chi}[n])} \tag{11}$$

If desired, the estimated probability prob[n] can also be time-smoothed using a small forgetting factor to track sudden bursts in speech. To obtain binary decisions of speech absence and presence, the estimated probability (prob$\epsilon$[0,1]) can be compared to a pre-selected threshold. Higher values of prob indicate higher probability of presence of speech. For instance the presence of speech in time frame n may be declared if prob[n]>0.7. Otherwise the frame may be considered to contain only non-speech activity. The proposed embodiments produce more accurate speech detection as a result of more accurate noise level determinations.

Improvements Upon Noise Estimation

Computation of the mean and standard deviation requires sufficient memory to store the past frame estimates. This requirement may be prohibitive for certain applications/devices that have limited memory (such as certain tiny portable devices). In such cases, the following approximations may be used to replace the above calculations. An approximation to the mean estimate may be computed by exponentially averaging the power estimate x(n) with a smoothing constant $\alpha_M$. Similarly, an approximation to the variance estimate may be computed by exponentially averaging the square of the power estimates with a smoothing constant $\alpha_V$, where n denotes the frame index.

$$\bar{x}(n)=\alpha_M\bar{x}(n-1)+(1-\alpha_M)x(n) \tag{12},$$

$$\bar{v}(n)=\alpha_V\bar{v}(n-1)+(1-\alpha_V)x^2(n) \tag{13}$$

Alternatively, an approximation to the standard deviation estimate may be obtained by taking the square root of the variance estimate $\bar{v}$(n). The smoothing constants $\alpha_M$ & $\alpha_V$ may be chosen in the range [0.95, 0.99] to correspond to an averaging over 20-100 frames. Furthermore, an approximation to $\hat{\sigma}_1^2$[n] may be obtained by computing the difference between mean and scaled standard deviation estimates. Once the mean-minus-scaled standard deviation estimate is obtained, a minimum statistics on the difference for over a set of, say, 100 frames may be performed.

This feature alone provides superior tracking of non-stationary noise peaks, as compared with minimum statistics. In some embodiments, to compensate for the desired speech peaks affecting the noise level estimation, the standard deviation of the noise level is subtracted. However, excessive subtraction in equation 7 may result in an under-estimated noise level. To address this problem, a long term average during speech absences may be run, i.e.

$$H_0[n]:\lambda_{d_1}[n]=\alpha_1\lambda_d[n-1]+(1-\alpha_1)\sigma_y^2[n] \tag{14},$$

$$H_1[n]:\lambda_{d_1}[n]=\lambda_{d_1}[n-1] \tag{15}$$

where $\alpha_1$=0.9999 is the smoothing factor and the noise level is estimated as:

$$\hat{\sigma}_n^2[n]=\max(\hat{\sigma}_2^2[n],\lambda_{d_1}[n]) \tag{16}$$

Noise Bounding

Typically, when incoming signals are very clean (high SNR), noise levels are typically under-estimated. One way to resolve this issue is to lower-bound the noise level to be say at least 18 dB below the desired signal level $\sigma^2_{desired}$. Lower bounding can be accomplished using the following flooring operations:

$$\sigma^2_{desired}[n] = \alpha_2\sigma^2_{desired}[n-1] + (1-\alpha_2)\sum_{i=n-100}^{n} |y[n]|^2 \tag{17}$$

```
SNR_diff[n] = SNR_estimate[n] − Longterm_Avg_SNR[n]

If Σ_{i=n−100}^{n} |y[n]|^2 > Δ1

    If σ_noise^2[n − 1] > Δ2
        floor1[n] = σ_desired^2[n]/Δ3
        If floor[n − 1] < floor1[n]
            floor[n] = floor1[n]
        elseif SNR_diff[n − 1] > Δ4
            If σ_noise^2[n − 1] < Δ5
                floor[n] = floor1[n]
            End
        End
    End
End
```

$\sigma_{noise}^2$[n]=max($\hat{\sigma}_n^2$[n], floor[n]) where the factors $\Delta_1$ through $\Delta_5$ are tunable and SNR_Estimate and Longterm_Avg_SNR are the a posterior SNR and long term SNR estimates obtained using noise estimates $\sigma_{noise}^2$[n] and $\lambda_{d_1}$[n] respectively. In this manner the noise level may be bounded between 12-24 dB below an active desired signal level as required.

Frequency-Based Noise Estimation

Embodiments additionally include a frequency domain sub-band based computationally involved speech detector which can be used in other. Here, each time frame is divided into a collection of the component frequencies represented in the Fourier transform of the time frame. These frequencies remain associated with their respective frame in the "time-frequency" bin. The described embodiment then estimates the probability of the presence of speech in each time-frequency bin (k,n), i.e. $k^{th}$ frequency bin and $n^{th}$ time frame.

Some applications require the probability of speech presence to be estimated at both the time-frequency atom level and at a time-frame level.

Operation of the speech detector in each time-frequency bin may be similar to the time-domain implementation described above, except that it is performed in each frequency bin. Particularly, the noise level $\lambda_d$ in each time-frequency bin (k,n) is estimated by interpolating between the noise level in the past frame $\lambda_d[k, n-1]$ and signal energy for the past 100 frames at this frequency $$\sum_{i=n-100}^{n} |Y(k, i)|^2,$$

using a smoothing factor $\alpha_s$:

$$\lambda_d[k, n] = \alpha_s[k, n]\lambda_d[k, n-1] + (1 - \alpha_s[k, n]) \sum_{i=n-100}^{n} |Y(k, i)|^2 \tag{18}$$

The smoothing factor $\alpha_s$ may itself depend on an interpolation between the present probability of speech and 1 (i.e., how often can it be assumed that speech is present).

Error! Objects cannot be created from editing field codes. (19)

In the above equations Y(k,i) is the contaminated signal in the $k^{th}$ frequency bin and $i^{th}$ time-frame. The preliminary noise level in each bin may be estimated as:

$$\hat{\sigma}_1^2[k,n]=[\lambda_d[k,n-100:n]-\sigma(\lambda_d[k,n-100:n])] \tag{20},$$

$$\hat{\sigma}_2^2[k,n]=\min(\hat{\sigma}_1^2[k,n-100:n]) \tag{21}$$

Similar, to the time domain VAD, a long term average during speech presence $H_0$ and absence $H_1$ may be performed according to the following equation, $$H_0[k, n]:\lambda_{d_1}[k, n] = \alpha_l\lambda_d[k, n-1] + (1 - \alpha_l) \sum_{i=n-100}^{n} |Y(k, i)|^2, \tag{22}$$

$$H_1[k, n]:\lambda_{d_1}[k, n] = \lambda_{d_1}[k, n-1] \tag{23}$$

The secondary noise level in each time-frequency bin may then be estimated as $$\hat{\sigma}_n^2[k,n]=\max(\hat{\sigma}_2^2[k,n],\lambda_{d_1}[k,n]) \tag{24}$$

To address the problem of underestimation in the noise level for some high SNR bins, the following bounding conditions and equations may be used $$\sigma^2_{desired}[k, n] = \alpha_2\sigma^2_{desired}[k, n-1] + (1 - \alpha_2) \sum_{i=n-100}^{n} |y[k, n]|^2 \tag{25}$$

SNR_diff[k, n] = SNR_estimate[k, n] − Longterm_Avg_SNR[k, n]

If $\sum_{i=n-100}^{n} |y[k, n]|^2 > \Delta_1$

If $\sigma_{noise}^2[k, n-1] > \Delta_2$
floor$_1$[k, n] = $\sigma_{desired}^2[k, n]/\Delta_3$
If floor[k, n − 1] < floor$_1$[k, n]

-continued floor[k, n] = floor$_1$[k, n]
elseif SNR_diff[k, n − 1] > $\Delta_4$
If $\sigma_{noise}^2[k, n-1] < \Delta_5$
floor [k, n] = floor$_1$[k, n]
End
End
End
End $\sigma_{noise}^2[k,n]=\max(\hat{\sigma}_n^2[k,n], \text{floor}[k,n])$ where the factors $\Delta_1$ through $\Delta_5$ are tunable and SNR_Estimate and Longterm_Avg_SNR are the a posterior SNR and long term SNR estimates obtained using noise estimates $\sigma_{noise}^2[k,n]$ and $\lambda_{d_1}[k,n]$ respectively. $\sigma_{noise}^2(k,n)$ represents the final noise level in each time-frequency bin.

Next, equations based on the time domain mathematical model described above (equations 2 to 17) may be used to estimate the probability of the presence of speech in each time-frequency bin. Particularly, the a posteriori SNR in each time-frequency atom is given by $$\chi[k, n] = 10\left\{\log_{10}\left(\sum_{i=n-100}^{n} |Y[k, i]|^2\right) - \log_{10}(\sigma^2_{noise}[k, n])\right\} \tag{26}$$

For stability, one can also do time smoothing of the above quantity:

$$\hat{\chi}[k,n]=\beta_1\hat{\chi}[k,n-1]+(1-\beta_1)\chi[k,n]$$

$$\beta_1\epsilon[0.75,0.85] \tag{27}$$

and the probability of the presence of speech in each time-frequency atom is given by $$prob[k, n] = \frac{1}{1 + \exp(-\hat{\chi}[k, n])} \tag{28}$$

Where prob[k,n] denotes the probability of the presence of speech in the $k^{th}$ frequency bin and the $n^{th}$ time frame.

Bi-Level Architecture

The above-described mathematical models permit one to flexibility combine the output probabilities in each time-frequency bin optimally, to get an improved estimate of the probability of speech occurrence in each time-frame. One embodiment, for example, contemplates a bi-level architecture, wherein a first level of detectors operates at the time-frequency bin level, and the output is inputted to a second time-frame level speech detector.

Figure 2:
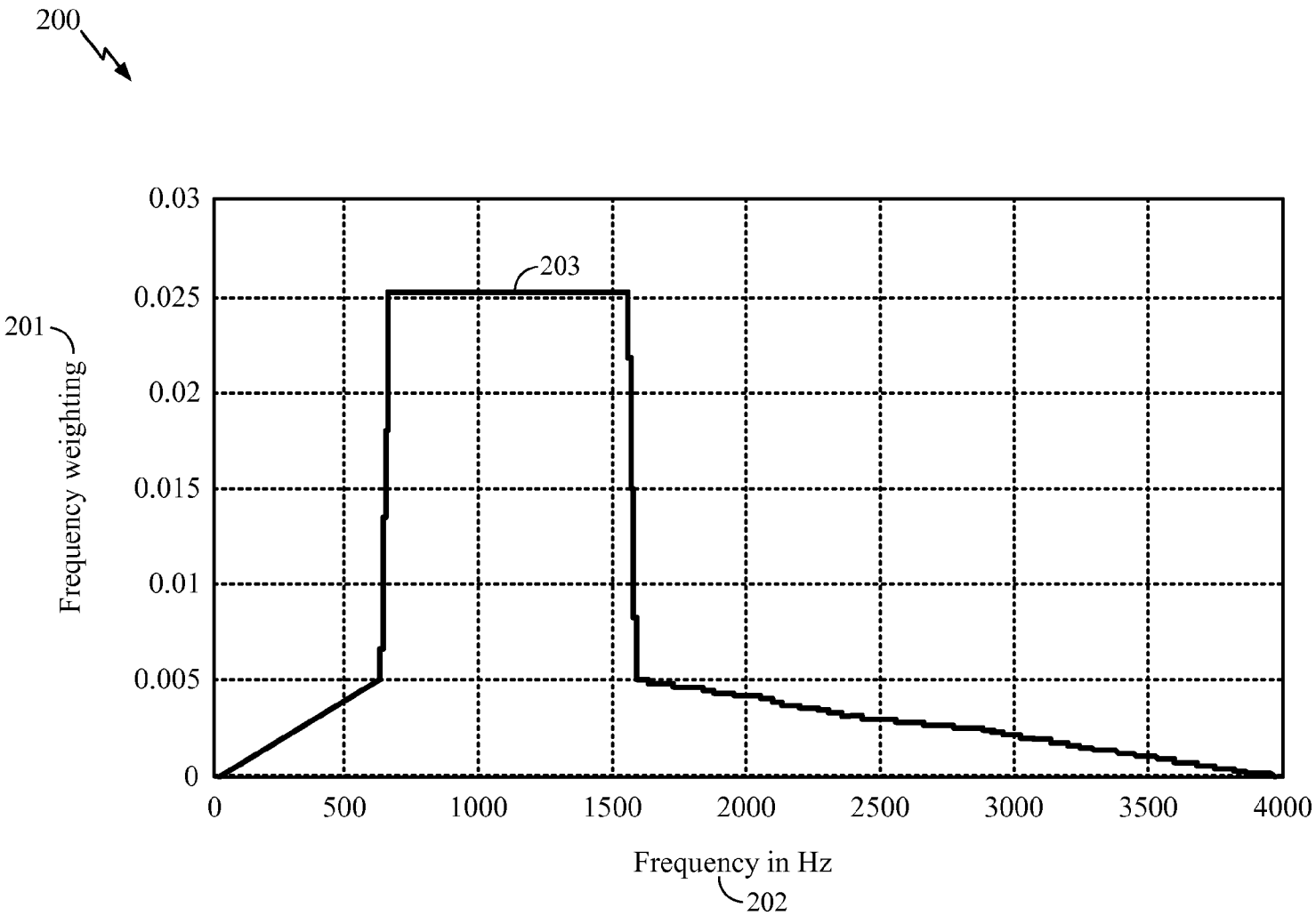
FIG. 2 is a graph illustrating the frequency selectivity weighting vector for the frequency domain VAD.

The bi-level architecture combines the estimated probabilities in each time-frequency bin to get a better estimate of the probability of the presence of speech in each time-frame. This approach may exploit the fact that the speech is predominant in certain bands of frequencies (600 Hz to 1550 Hz). FIG. 2 illustrates a plot of a plurality of frequency weights 203 used in some embodiments. In some embodiments, these weights are used to determine a weighted average of the bin level probabilities as shown below $$prob[n] = \sum_{i=1}^{N} W_i\left(\frac{1}{1 + \exp(-\hat{\chi}[i, n])}\right) \tag{29}$$

-continued $$\sum_{i=1}^{N} W_i = 1$$

where the weight vector W comprises the values shown in FIG. 2. Finally, a binary decision of speech presence or absence in each frame can be made by comparing the estimated probability to a pre-selected threshold, similar to the time domain approach.

EXAMPLES

To evaluate the advantages of the above described embodiments, speech detection was performed using the time and frequency embodiments described above, as well as two leading VAD systems. The ROC curves for each of these demonstrations under varying noise environments in shown in FIGS. 3-6. Each of the time and frequency versions of the above embodiments performed significantly better than the standard VADs. For each of the examples, the noise database used was based on the standard recommended ETSI EG 202 396-1. This database provides standard recordings of car noise, street noise, babble noise etc. for voice quality and noise suppression evaluation purposes. Additional real world recordings were also used for evaluating the VAD performance. These noise environments contain both stationary and nonstationary noise, providing a challenging corpus on which to test. The SNR of 5 dB was further chosen to make detection exceptionally difficult (typical office noise would be on the order of 30 dB).

Example 1

To evaluate the proposed time domain speech detector, the receiver operating characteristics (ROC) under varying noise environments and at a SNR of 5 dB are plotted. As illustrated in FIG. 2, ROC curves plot the probability of detection (detecting the presence of speech when it is present) 301 versus the probability of false alarm (declaring the presence of speech when it is not present) 302. It is desirable to have very low false alarms at a decent detection rate. Higher values of probability of detection for a given false alarm indicate better performance, so in general the higher curve is the better detector.

The ROCs are shown for four different noises—pink noise, babble noise, traffic noise and party noise. Pink noise is a stationary noise with power spectral density that is inversely proportional to the frequency. It is commonly observed in natural physical systems and is often used for testing audio signal processing solutions. Babble noise and traffic noise are quasi-stationary in nature and are commonly encountered noise sources in mobile communication environments. Babble noise and traffic noise signals are available in the noise database provided by ETSI EG 202 396-1 standards recommendation. Party noise is a highly non-stationary noise and it is used as an extreme case example for evaluating the performance of the VAD. Most single-microphone voice activity detectors produce high false alarms in the presence of party noise due to the highly non-stationary nature of the noise. However, the proposed method in this invention produces low false alarms even with the party noise.

Figure 3:
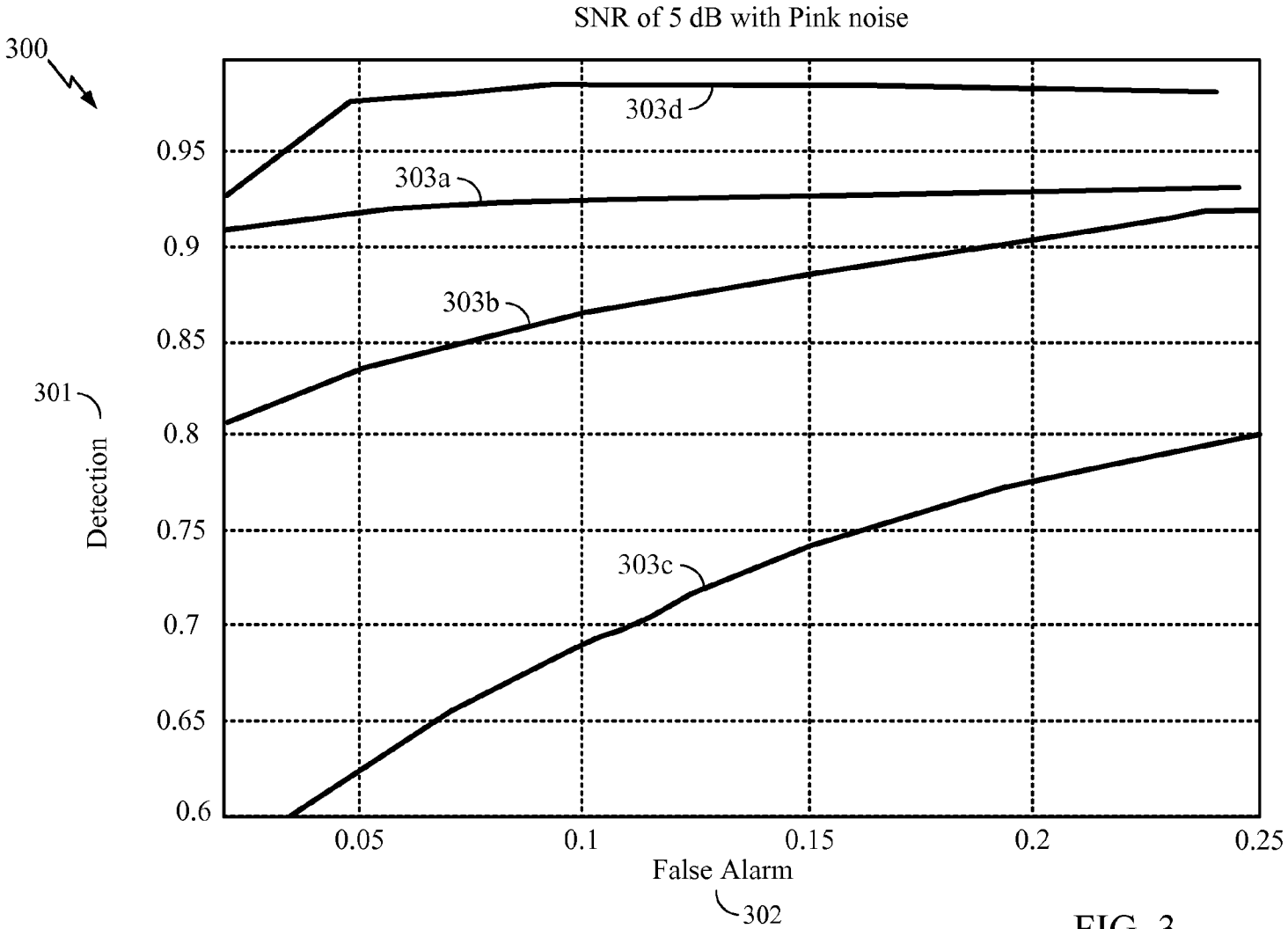
FIG. 3 is a graph illustrating the performance of the proposed time domain VAD under pink noise environment.

FIG. 3 illustrates the ROC curves of a first standard VAD 303*c*, a second standard VAD 303*b*, one of the present time-based embodiments 303*a*, and one of the present frequency-based embodiments 303*d*, are plotted in a pink noise environment. As shown, the present embodiments 303*a*, 303*d* significantly outperformed each of the first 303*b* and second 303*c* VADS, always registering higher detections 301 as the false alarm constraint 302 was relaxed.

Example 2

Figure 4:
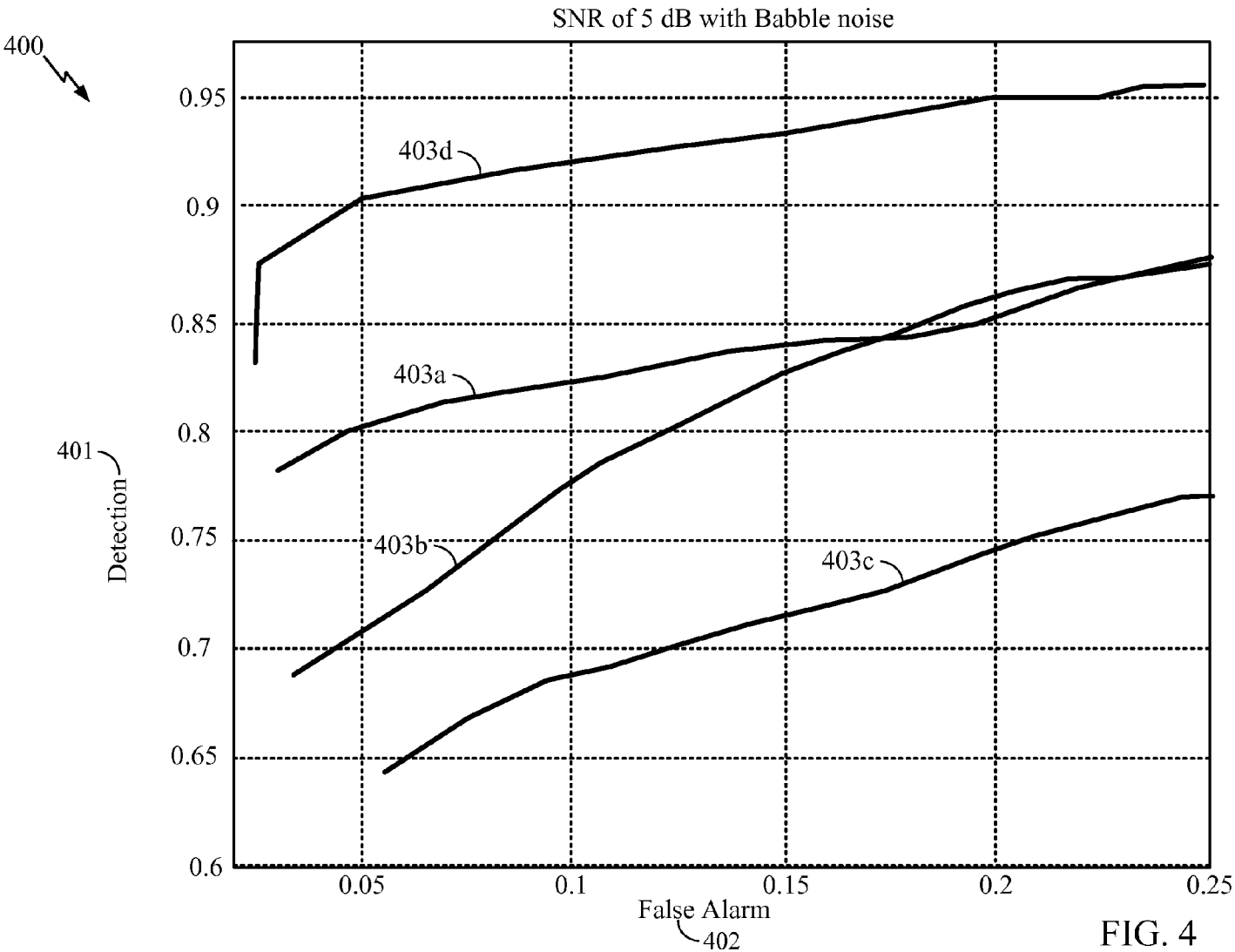
FIG. 4 is a graph illustrating the performance of the proposed time domain VAD under babble noise environment.

FIG. 4 illustrates the ROC curves of a first standard VAD 403*c*, a second standard VAD 403*b*, one of the present time-based embodiments 403*a*, and one of the present frequency-based embodiments 403*d*, are plotted in a babble noise environment. As shown, the present embodiments 403*a*, 403*d* significantly outperformed each of the first 403*b* and second 403*c* VADS, always registering higher detections 401 as the false alarm constraint 402 was relaxed.

Example 3

Figure 5:
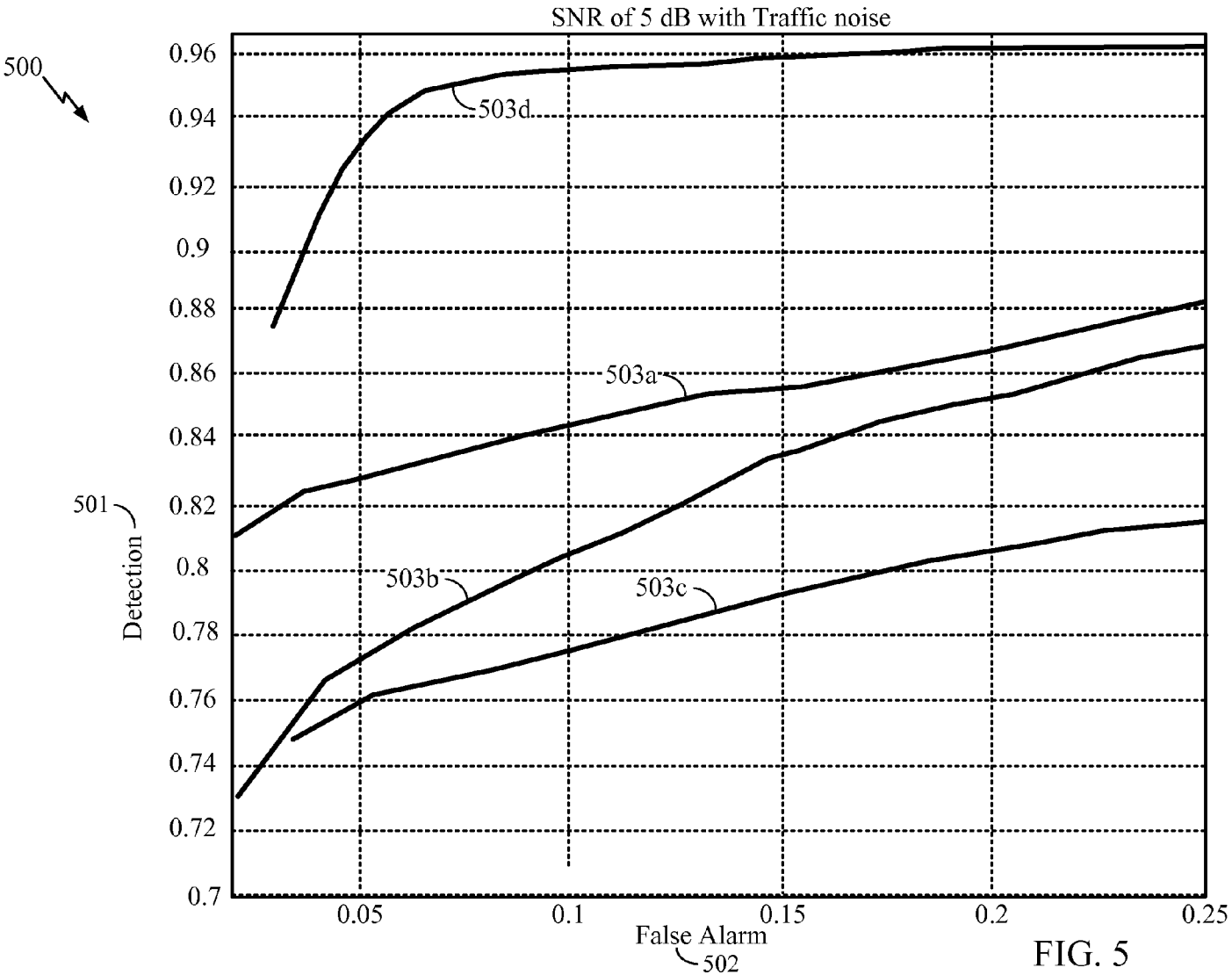
FIG. 5 is a graph illustrating the performance of the proposed time domain VAD under traffic noise environment.

FIG. 5 illustrates the ROC curves of a first standard VAD 503*c*, a second standard VAD 503*b*, one of the present time-based embodiments 503*a*, and one of the present frequency-based embodiments 503*d*, are plotted in a traffic noise environment. As shown, the present embodiments 503*a*, 503*d* significantly outperformed each of the first 503*b* and second 503*c* VADS, always registering higher detections 501 as the false alarm constraint 502 was relaxed.

Example 4

Figure 6:
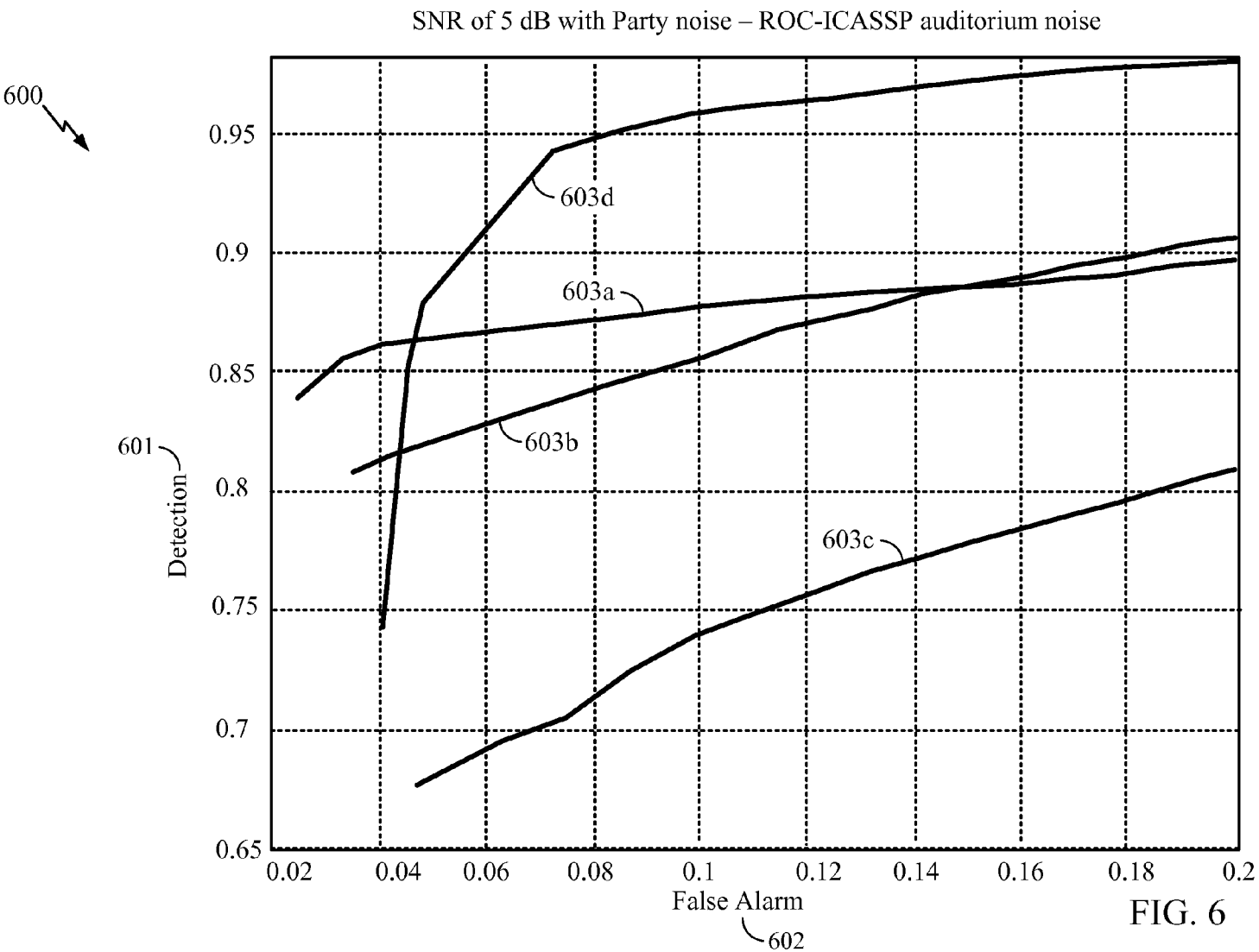
FIG. 6 is a graph illustrating the performance of the proposed time domain VAD under party noise environment.

FIG. 6 illustrates the ROC curves of a first standard VAD 603*c*, a second standard VAD 603*b*, one of the present time-based embodiments 603*a*, and one of the present frequency-based embodiments 603*d*, are plotted in the ROC-ICASSP auditorium noise environment. As shown, the present embodiments 603*a*, 603*d* significantly outperformed each of the first 603*b* and second 603*c* VADS, always registering higher detections 601 as the false alarm constraint 602 was relaxed.

The techniques described in this disclosure may be implemented in hardware, software, firmware, or any combination thereof. Any features described as units or components may be implemented together in an integrated logic device or separately as discrete but interoperable logic devices. If implemented in software, the techniques may be realized at least in part by a computer-readable medium comprising instructions that, when executed, performs one or more of the methods described above. The computer-readable medium may form part of a computer program product, which may include packaging materials. The computer-readable medium may comprise random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates code in the form of instructions or data structures and that can be accessed, read, and/or executed by a computer.

The code may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated software units or hardware units configured for encoding and decoding, or incorporated in a combined encoder-decoder (CODEC). Depiction of different features as units or modules is intended to highlight different functional aspects of the devices illustrated and does not necessarily imply that such units must be realized by separate hardware or software components. Rather, functionality associated with one or more units or modules may be integrated within common or separate hardware or software components. The embodiments may be implemented using a computer processor and/or electrical circuitry.

Various embodiments of this disclosure have been described. These and other embodiments are within the scope of the following claims.

What is claimed is:

1. A method for estimating the noise level in a current frame of an audio signal, comprising:

determining the noise levels of each frame of a plurality of audio frames;

calculating the mean and the standard deviation of the noise levels over the plurality of audio frames; and calculating the noise level estimate of the current frame as the value of the standard deviation subtracted from said mean.

2. The method of claim 1, further comprising scaling the standard deviation prior to subtracting from the mean.

3. The method of claim 1, further comprising determining the current noise level estimate by determining the minimum of a plurality of noise level estimates.

4. The method of claim 1, wherein the plurality of audio frames comprises about 100 frames.

5. The method of claim 1, wherein calculating the noise level estimate comprises using a smoothing factor.

6. The method of claim 5, wherein the noise level estimate is held constant during periods of speech activity.

7. The method of claim 5, wherein the smoothing factor is recursively averaged by interpolating between a probability of speech in the current frame and 1 using a second smoothing factor.

8. The method of claim 1, wherein the noise level estimate comprises the minimum of a plurality of previously determined noise levels.

9. The method of claim 1, wherein the mean of the noise levels is estimated by interpolating a previously calculated mean of the noise levels with a present noise level.

10. The method of claim 1, further comprising bounding the calculated noise level estimate between 12-24 dB below a desired signal level.

11. The method of claim 1, further comprising detecting speech activity by identifying the current frame as having non-noise segments.

12. The method of claim 11, wherein speech activity is declared when a probability of speech $>\tau$ for all $\tau\epsilon[0.2,1)$.

13. A noise determination system comprising:

a first module configured to determine the noise levels of each of a plurality of audio frames;

a second module configured to calculate the mean and the standard deviation of the noise levels over the plurality of audio frames; and a third module configured to calculate a noise level estimate of a current frame as the value of the standard deviation subtracted from said mean.

14. The noise determination system of claim 13, wherein the third module is configured to scale the standard deviation prior to subtracting from the mean.

15. The noise determination system of claim 13, wherein calculating the noise level estimate comprises using a smoothing factor.

16. The noise determination system of claim 15 wherein the noise level estimate is held constant during periods of speech activity.

17. The noise determination system of claim 15, wherein the smoothing factor is recursively averaged by interpolating between a probability of speech in the current frame and a value of 1 using a second smoothing factor.

18. A system for estimating the noise level in a current frame of an audio signal, comprising:

means for determining the noise levels of each of a plurality of audio frames;

means for calculating the mean and the standard deviation of the noise levels over the plurality of audio frames; and means for calculating the noise level estimate of the current frame as the value of the standard deviation subtracted from said mean.

19. The noise determination system of claim 18, wherein the means for calculating a noise level estimate of the current frame scales the standard deviation prior to subtracting from the mean.

20. The system of claim 18, wherein the means for determining the noise levels comprises a module configured to determine the energy level of a signal.

21. The system of claim 18, wherein the means for calculating the mean and the standard deviation of the noise levels comprises a module configured to perform mathematical operations.

22. The system of claim 18, wherein the means for calculating a noise level estimate comprises a module configured to perform mathematical operations.

23. A non-transitory computer readable medium comprising instructions that when executed on a processor perform a method comprising:

determining the noise levels of each of a plurality of audio frames;

calculating the mean and the standard deviation of the noise levels over the plurality of audio frames; and calculating a noise level estimate of a current frame as the value of the standard deviation subtracted from said mean.

24. The method of claim 23, further comprising scaling the standard deviation prior to subtracting from the mean.

25. A processor programmed to perform a method comprising:

determining the noise levels of each of a plurality of audio frames;

calculating the mean and the standard deviation of the noise levels over the plurality of audio frames; and calculating a noise level estimate of a current frame as the value of the standard deviation subtracted from said mean.

26. The method of claim 25, further comprising scaling the standard deviation prior to subtracting from the mean.

* * * * *